US005095700A

United States Patent [19]

Bolger

[11] Patent Number: 5,095,700

[45] Date of Patent: Mar. 17, 1992

[54] STIRLING ENGINE

[76] Inventor: Stephen R. Bolger, 127 W. 79th St., Apt. 11J, New York, N.Y. 10024

[21] Appl. No.: 714,667

[22] Filed: Jun. 13, 1991

[51] Int. Cl.[5] ..... F02G 1/043

[52] U.S. Cl. ..... 60/517; 62/6

[58] Field of Search ..... 60/517, 519, 521, 525, 60/526; 62/6

[56] References Cited

U.S. PATENT DOCUMENTS

| | | | |
|---|---|---|---|
| 3,999,388 | 12/1976 | Nystrom | 60/521 |
| 4,179,891 | 12/1979 | Gronvall | 60/521 |
| 4,364,233 | 12/1982 | Stang | 60/712 |
| 4,428,197 | 1/1984 | Liljequist | 60/525 |
| 4,455,825 | 6/1984 | Pinto | 60/517 |
| 4,522,030 | 6/1985 | Corey | 60/525 |
| 4,633,668 | 1/1987 | Corey | 60/526 |
| 4,697,420 | 10/1987 | Schneider et al. | 60/525 |

*Primary Examiner*—Allen M. Ostrager

*Attorney, Agent, or Firm*—Samuels, Gauthier & Stevens

[57] ABSTRACT

A reversible thermal engine is provided which operates on the principles of the Stirling and Ericsson cycles. The engine comprises two variable volume compartments connected by passageway with a regenerator therein. Heat exchangers provide heating and cooling to the working gas during the cycle. Control means are provided to vary the volume of the gas transferring between compartments such that the volume variations of the gas are in the form of overlapping quadrilateral waveforms.

7 Claims, 3 Drawing Sheets

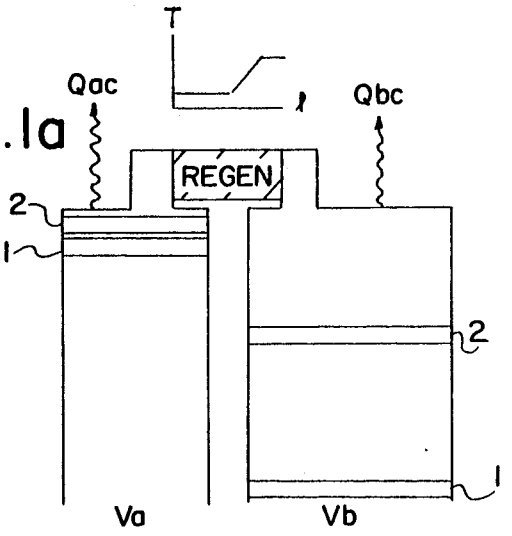
FIG. 1a
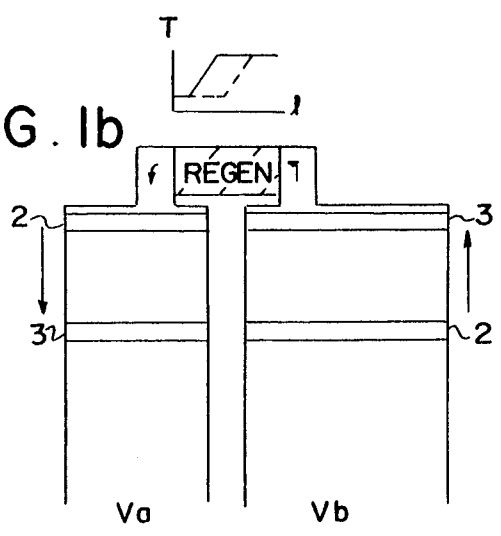
FIG. 1b
FIG. 1c
FIG. 1d

STIRLING ENGINE

FIELD OF THE INVENTION

The invention comprises a reversible heat engine intended to operate in the well known Stirling and Ericsson cycles. Engines designed according to the invention largely avoid the inherent losses which prevent prior machines from approaching the theoretically possible Carnot equivalent efficiency. Methods of modeling these complicated cycles are presented, the sources of inherent inefficiencies are identified, and methods of quantification and control are disclosed.

BACKGROUND OF THE INVENTION

A Stirling cycle heat engine generally consists of a variable volume sealed enclosure which contains a fixed quantity of a well behaved relatively ideal gas, typically helium. The enclosure is subdivided into two compartments by a gas permeable barrier which thermally isolates the two compartments from each other. The barrier is a porous medium made of very finely divided material which stores heat to and from gas passing through it.

The two thermally isolated compartments are separately held in close thermal contact with two thermal reservoirs at differing temperatures. Means are provided to vary the allocation of gas between the two compartments in a timed, phase shifted relationship with respect to the cyclic variation of the overall enclosure volume. The gas pressure is always very close to equal in both compartments because the thermal barrier between them is freely gas permeable. The phase shift causes a preponderance of gas to reside in one compartment during the portion of the cycle when the overall volume is being reduced or "compressed", and in the other compartment when the overall volume is being increased or "expanded". As a result, net heat is rejected to an attached thermal reservoir by the compartment which contains the preponderance of the gas during compression, and net heat is absorbed from another thermal reservoir by the compartment which contains the preponderance of the gas during expansion.

If the compartment which contains the dominant quantity of gas during expansion is maintained at an elevated temperature with respect to the temperature of the compartment containing the predominance of gas during compression, net work is available from the cycle; it produces power. But if compression occurs when the predominance of gas resides in the warmer compartment and expansion when the bulk of the gas resides in the cooler one, external work will be required to carry out the overall volume variation, and a quantity of heat will be pumped from the cooler reservoir to the warmer; the cycle produces refrigeration.

Stirling and Ericsson engines are potentially useful as both engines and refrigerators, if competitive efficiencies are attained. Present vapor cycle refrigerators reach about 75% of Carnot equivalent coefficient of performance.

The gas permeable medium which thermally isolates the two compartments first stores and then gives back a certain quantity of heat from the gas. At the end of the cycle the medium must be returned to the identical state in which it started the cycle. In a Stirling cycle heat engine, the gas is made to transit the porous medium "regenerator" at constant volume. The pressure of the gas within the overall volume thus changes as gas is shifted through the regenerator. In an Ericsson cycle heat engine, the gas is made to transit the regenerator at constant pressure. The cycles differ crucially in the behavior of the overall volume during the shifting of the gas through the regenerator. A Stirling engine does the shifts isochorically whereas an Ericsson engine does them isobarically.

The Ericsson cycle also differs from the Stirling in the allocation of displacement between the two compartments within the overall volume. Stirling engines usually have approximately equal displacements in both compartments. In Ericsson engines, the volume variation of the warmer compartment is made greater than the volume variation of the cooler one by the ratio of design absolute temperatures at which the two compartments will operate. In an Ericsson engine the expansion pressure ratio must always equal the compression pressure ratio.

In usual practice, Stirling engines do not perform the separate compression, shift, expansion, and shift back steps in an isolated and discrete manner. Rather, each step overlaps it neighbors. In theory, the effectiveness of the cycle depends only on obtaining a net predominance of gas in one compartment during the compression process and in the other compartment during the expansion process. During some part of each cycle a certain amount of heat is transferred in the wrong direction in each of the two compartments, but the preponderance of the gas resides in the other compartment during such times.

The Ericsson cycle must necessarily isolate the cycle into its four discrete steps. Thus, most prior Ericsson cycle engines have employed continuous flow compression and expansion processes, and counter-flow recuperators rather than regenerators. But it is also possible to operate a two compartment engine resembling a Stirling in the Ericsson cycle by, for instance, actuating the pistons through properly shaped and timed cams in conjunction with the volume variation ratios earlier described.

Like a Stirling, a positive displacement Ericsson cycle engine must maintain a preponderance of gas in one compartment during the overall volume compression, and in the other compartment during overall volume expansion. Similarly, there is a quantity of reverse heat transfer in each compartment during some portion of the cycle because the pressure change acting on the gas remaining within induces temperature change and heat flow during the opposing step of the cycle.

Stirling and related engines of the prior art have generally employed pistons, cylinders and a variety of linkages to obtain the necessary phased relationships of thermally isolated volumes connected through a regenerator. The pistons have been connected to cranks, swash plates, cams, etc. Engines have been constructed with single and multiple pistons, single and dual action pistons, free pistons, and fixed and moving regenerators. The Wankel displacement mechanism originally developed for Otto cycle engines has also been adapted to the Stirling cycle. Generally, the variable volume actuation means produce sinusoidal volume variations.

As earlier mentioned, there is always a certain amount of heat flow in the reverse direction in both compartments during some portions of the Stirling and Ericsson cycles. It is instructive to estimate the magnitude of forward, reverse and net heat flows in typical engines.

Because the volumes vary sinusoidally and the cycle is not isolated into truly discrete steps, the Stirling cycle can be difficult to model mathematically. To allow calculation of the reversing heat flows the cycle must be treated as a unified whole which includes the effects of the overlapping of steps.

With assumption of isothermal compression and expansion and neglect of detail regenerator effects it is easy to derive a model which explicitly treats the overlapping sinusoidal volume variations. The key simplification is the presumption that the gas temperatures in each compartment always equal the attached thermal reservoir temperatures. In other words, the heat exchangers are presumed to be perfect. Pressure becomes a function of the volumes and temperatures only, allowing the straightforward derivation of two integrals which represent the work done and heat transferred in each of the two compartments. The two integrals do not have an easy analytical solution, but they easily integrate numerically.

A computer spreadsheet program may be used to perform such numerical integrations. The cycle is divided into discreet intervals and the integral terms derived by the above method evaluated for each. The intervals are summed to obtain the net cycle work and heat flows.

The use of spreadsheet software allows quick trial of varying parameters and observance of the effects.

These methods were used to estimate the magnitudes of forward and reverse heat flows in a Stirling machine with working gas temperatures such as would be encountered in a deep freezer refrigeration application; 225° K. gas temperature in the heat absorbing compartment and 325° K. in the heat rejecting compartment. Live volume in each compartment was set equal to dead volume and the two compartments were assumed to have the same total variation, as is typical of most prior art Stirling engine designs. The phase angle was chosen to maximize specific work. The cycle was divided up into eight intervals of integration and the heat flow calculated for each.

Like any ideal analysis of the Stirling cycle, the method predicts Carnot equivalent performance. But inspection of the heat flow terms for the intervals comprising the cycle reveals the principle efficiency bottleneck. The forward heat flows are only about 25% larger than the reverse heat flows. To pump one net watt the machine will push five and pull back four. The total heat flow exceeds the net heat flow by almost an order of magnitude.

The reverse heat flow is also huge compared to the net mechanical work of the cycle. Clearly an inefficiency in the heat transfer process will profoundly affect cycle efficiency. The ideal cycle model predicts Carnot equivalent performance only because the heat exchangers were presumed to be perfect. Real heat exchangers are far from perfect, as real Stirling engines are far from efficient: Imperfect heat transfer allows the gas temperature to fluctuate. This will cause a "hysteresis loss" in the heat transfer process.

The magnitude of hysteresis loss in the heat exchangers can be estimated after making reasonable assumptions as to the approach temperatures attainable in the heat exchangers. Obviously, the gas temperature must differ from the heat exchanger surface temperature to drive heat flow. Thus, the gas temperature in both heat exchangers will exceed each heat exchanger surface temperature during compression or overall volume reduction. Likewise, the gas temperature in both compartments will be lower than the respective heat exchanger surface temperature during expansion or overall volume increase. Additionally, some of the pressure variation will occur semi-adiabatically as the temperature of the gas fluctuates.

The effect of the approach temperature fluctuations is to increase the amount of work required to compress the gas in the expansion compartment during overall volume reduction, and reduce the work available from the gas in the compression compartment during the overall volume increase. Both these effects increase the work required to perform the refrigeration cycle, or reduce the net work available from an engine cycle.

The magnitude of hysteresis loss is directly related to the magnitude of the temperature fluctuation and the quantity of gas in the adverse compartment. It is easily estimated by retaining the assumptions that compression and expansion are isothermal, but occur at temperatures above and below the actual heat exchanger surface temperatures. Then, the work and heat transfers in the reverse directions are found by scaling up the ideal reverse direction heat flows from the ideal cycle model by the ratio of the absolute gas temperatures during the compression and expansion steps in the respective compartments. The difference between scaled and ideal values is the hysteresis loss.

Generally, it is extremely difficult to hold the gas temperature fluctuation below 20° K. (10° K. above and below the heat exchanger inner surface temperature) in either of the two compartments. If the refrigeration machine described above had this fluctuation the compression work expended on the expansion chamber would be increased by the ratio 245/225 or 1.09. Similarly the expansion work available from the gas in the compression compartment would be only 305/325 or 0.94 times the ideal. Because the reverse direction work and heat flows are so great, these effects combine to seriously degrade efficiency. Under the example conditions the coefficient of performance is reduced to less than unity by heat exchanger hysteresis loss, as compared to the Carnot equivalent COP of 2.25. The machine could not work as an engine.

This analysis is very much oversimplified by its failure to treat the semi-adiabatic portions of the cycles. Even so, it predicts losses in the range of those experienced in practice.

Clearly, heat exchanger hysteresis loss is significant. Its magnitude is at least partly decreased by reducing the dead volume of the two compartments to lessen the quantity of gas in the wrong compartment during the adverse portion of the cycle. However, even at the practical minimum of dead volume ratio, about 10%, forward heat transfer exceeds the reverse by only a ratio of two. The cycle remains quite sensitive to temperature fluctuation in the heat exchangers.

Unfortunately, reducing the dead volume greatly increases the cycle pressure ratio. This is undesirable because of adverse effects on the performance of the regenerator. It is useless to limit the cycle pressure ratio by making the phase shift unconventionally large because the relative magnitude of the reversed heat flows will also be increased by this method.

Generally, detailed analysis of the events in the regenerator has been neglected due to the great difficulty of modeling the unsteady, reversing flows and varying pressures. It is usually presumed that the regenerator is compatible with the isochoric shifting of the gas from one compartment to the other, and with the inevitable cycle pressure variation. This presumption is not true. The pressure fluctuations induced during the isochoric shifts and the cycle pressure fluctuations both cause the gas to go out of thermal equilibrium with the porous regenerator medium throughout its length. Unfortunately, packed bed or porous regenerators are efficient only if they remain in close thermal equilibrium with the gas. They work best under isobaric conditions. Heat exchange with the gas ideally occurs only in a well defined sharp front that is displaced in proportion to gas movement through the medium. The spurious heat exchange induced by the isochoric pressure fluctuation involves irreversibilities which are very damaging the cycle efficiency.

The Ericsson cycle, with its isobaric shifting of the gas through the regenerator, avoids irreversibility losses during the shift steps. It is thus more compatible with porous medium regeneration than the Stirling cycle. Both cycles must have pressure variation during the cycle in order to work at all, but the pressure ratio should be limited to minimize the extent of disequilibrium in the regenerator. Thermal lag in the heat exchange between the gas in the regenerator and the regenerator medium increases the work required to execute the refrigeration cycle or reduces the output of an engine.

Gas movement through the regenerator during pressure changes also drives a heat leak of potentially significant magnitude. Both compression and expansion tend to push the temperature front in the regenerator towards the cooler compartment. This movement of the front occurs on top of the normal front movements induced by the intrinsic cycle shifts. Unfortunately the pressure induced front movements add rather than cancel. There is thus always some unwanted heat transfer from warm compartment to cool, even in regenerators that should be very nearly perfect. Low cycle pressure variation reduces but never eliminates the effect.

Between them, heat exchanger hysteresis loss and regenerator compatibility problems account for the limited efficiency attained so far in Stirling cycle engines and refrigerators. The former alone is quantifiably so great as to preclude the possibility of constructing sinusoidal Stirling cycle refrigerators efficient enough to compete with vapor cycle machines. To closely approach the Carnot efficiency limit one must employ the method described hereinafter to control the magnitudes of heat exchanger hysteresis loss and operate in a manner more compatible with porous media regenerators.

BRIEF SUMMARY OF THE INVENTION

Broadly, the invention is an engine design which embodies four aspects.

First, heat flow reversal in the heat exchangers during execution of portions of the Stirling and Ericsson cycles substantially precludes attainment of high efficiency and thus must be minimized. Reverse heat flow is minimized only by minimizing the quantity of gas subject to the adverse conditions. This is partly achieved by minimizing dead volume. The heat exchangers are integrated with the variable volumes to reduce the dead volume to the least attainable. Compact regenerators with relatively low void fractions are employed.

Second, to further minimize reversed heat flows the greatest possible molar fraction of the working gas is shifted to the heat rejecting compartment before compression and to the heat absorbing compartment before expansion. In other words, the shift steps operate on the greatest practicable percentage of the gas content of the engine.

Third, pressure fluctuations during shifts of the gas through the regenerator must be avoided. Only the isobaric shifts of the Ericsson cycle are compatible with the use of porous or packed bed regeneration means. Furthermore, the Ericsson cycle pressure variations must be performed in a way that avoids movement of the temperature difference front in the regenerator during the compression and expansion steps. This is accomplished only by compressing or expanding both variable volumes to the same volume ratio simultaneously. Failure to observe this restriction results in net movement of the front during the cycle, causing a serious heat leak.

Lastly, sufficiently accurate performance in the Ericsson cycle requires non-sinusoidal volume variations. Careful control of volume variation is required to minimize reverse heat flow. It is necessary to compress the expansion compartment through the cycle pressure ratio during the cycle compression process and the compression compartment must be expanded through the cycle pressure ratio during the cycle expansion process to assure that mechanical work is efficiently recovered from the reversed heat flows. The volume variations must be driven in a quadrilateral wave such as by a cam.

An engine embodying the present invention comprises a two compartment device with variable volumes joined through a porous medium regenerator, the whole containing a fixed quantity of gas, combining variations of the volumes in accordance with the Ericsson cycle with minimized dead volume, heat exchangers integrated with the live volumes, maximum sweep of the gas between the compartments during the shifts, and volume variations in the form of overlapping quadrilateral waveforms which mechanically compress both compartments through the same volume ratio during the cycle compression step and mechanically expand both compartments through the same volume ratio during the cycle expansion step, ordinarily at low cycle pressure ratio to minimize pressure fluctuation in the regenerator.

BRIEF DESCRIPTION OF THE DRAWINGS

FIGS. 1*a*, 1*b*, 1*c* and 1*d* are illustrations of the successive steps of a recommended Ericsson cycle implementation with pistons serving as the positive displacement means;

DESCRIPTION OF THE PREFERRED EMBODIMENT(S)

Figure 2:
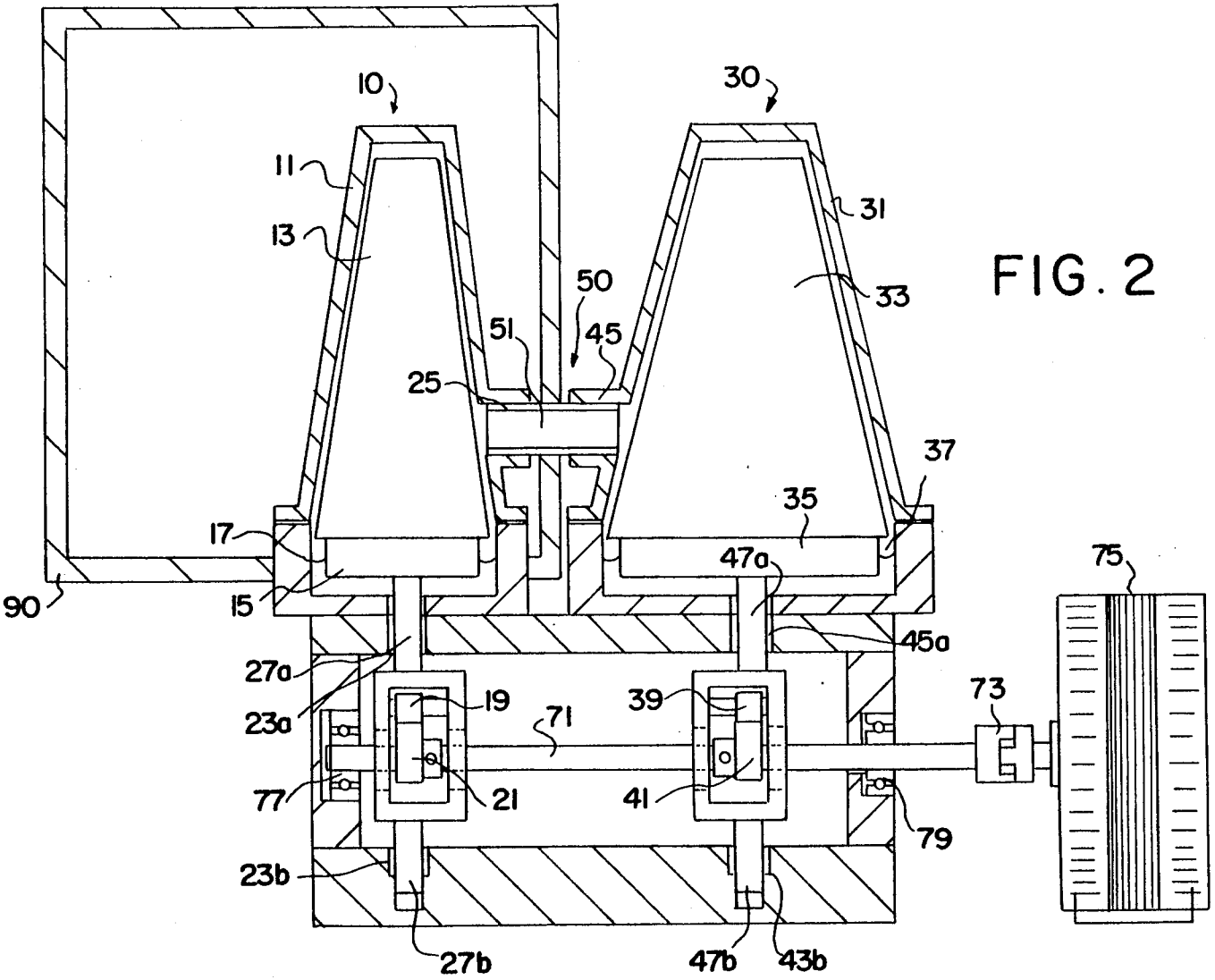
FIG. 2 is a side sectional elevation of a diaphragm sealed cam actuated engine embodying the invention.

The recommended Ericsson cycle is illustrated in FIG. 1. The four successive cycle steps are depicted by movement of pistons in cylinders. The gas is taken to be in thermal equilibrium with the respective cylinder walls throughout the cycle. The movement of the temperature discontinuity front in the regenerator is illustrated graphically. The Ericsson cycle displacement ratio requirement is met by making each cylinder diameter proportional to its intended operating absolute temperature. The cycle will be described for the same deep freezer refrigeration application discussed earlier, with $v_a$, the heat absorbing compartment, operating at 225° K. and $v_b$, the heat rejecting compartment, operating at 325° K. Total volume will be reduced to one half the initial volume during the compression step, and be expanded to twice its initial volume in the expansion step, producing a cycle pressure ratio of 2:1. The molar gas charge will be shifted to the greatest extent practicable, with 90% of the molar charge in the heat rejecting volume at commencement of compression, and 90% of the molar charge present in the heat absorbing volume at commencement of expansion. Dead volume in the regenerator is neglected.

The cycle illustration starts at the commencement of the compression step, FIG. 1(*a*). The heat rejecting volume, $v_b$, is at its maximum capacity, and the heat absorbing volume, $v_a$ is near its minimum capacity. However, since the compression must be explicitly carried out in both volumes, $v_a$ must retain sufficient room for compression at this stage so that it may be reduced through the cycle pressure ratio in the compression step to follow. Piston positions at the start of the compressions step are labeled "1", and "2" at the conclusion of the compression step. During compression, both $v_a$ and $v_b$ are reduced to one half their values at the start of compression, $v_a$ reaching its minimum. During compression, heat is isothermally rejected in both compartments. An amount of work equal to the heat rejected must be supplied to move the pistons. These quantities are indicated in the illustration. During compression, the temperature difference front in the regenerator remains fixed because no change of relative molar gas content occurs between the two compartments. The bulk of the heat is rejected where the bulk of the gas resides, $v_b$. However, heat is also rejected in $v_a$.

At the conclusion of compression, the shift of gas to the expansion volume commences. This step is illustrated in FIG. 1(*b*). Piston positions are labeled "2" and "3" at start and finish of this step respectively. At the start of the step 90% of the molar charge is in $v_b$. At its conclusion, 90% of the gas is in va, and $v_b$ reaches its minimum. No pressure change occurs. The temperature difference front is displaced towards $v_a$ as indicated. There is no heat transferred between the gas and the cylinder walls, because both remain at equal temperatures. Because the total volume is reduced during this shift, work must be applied. However, exactly this quantity of work will be later returned in the reverse shift step.

FIG. 1(*c*) illustrates the expansion step. Piston positions are labeled "3" at the beginning and "4" at the end. Both volumes increase by the cycle pressure ratio, work is done by the gas in both, and heat is absorbed in both. There is no movement of the temperature difference front in the regenerator during this step because the molar gas content of each compartment remains unchanged. At the conclusion of expansion $v_a$ reaches its maximum.

FIG. 1(*d*) shows the return of conditions to the original by the shift of the gas back to $v_b$ such that 90% of the molar content again resides there. During this shift the volume increase releases the work previously invested to perform the earlier shift and the temperature difference front is restored to its original position. Piston positions are labeled "4" and "1" at start and end of the step respectively.

The recommended cycle explicitly carries out isothermal compression and isothermal expansion in each compartment. This facilitates easy formulation of an ideal cycle model. The work done equals the heat transferred in the compression and expansion steps. These quantities are:

$$Q_c = -W_c = n_c T_c R \ ln\ (1/P_r)$$

$$Q_e = -W_e = n_e T_e R \ ln\ (P_r)$$

where:

T = compartment temperature
Q = heat transferred
W = work done
$P_r$ = cycle pressure (or volume) ratio
n = mole fraction of gas
R = universal gas constant The subscripts will indicate which compartment, a or b, and which process, compression, c, or expansion, e.

Combining the processes in both compartment results in:

$$W_c = -R\ (n_{ac}T_a + n_{bc}T_b)\ ln\ (P_r)$$

$$W_e = R\ (n_{ae}T_a + n_{be}T_b)\ ln\ (P_r)$$

$$W_{net} = W_c + W_e$$

$$Q_a = RT_a\ (n_{ae} - n_{ac})\ ln\ (P_r)$$

$$Q_b = RT_b\ (n_{bc} - n_{be})\ ln\ (P_r)$$

The forward heat flows thus exceed the reverse heat flows by the ratio of the molar gas content in the compartments during the forward and reverse steps of the cycle. It is practical to make forward heat flow exceed reverse heat flow by ratios up to about 9:1, while limiting the cycle pressure ratio to moderate levels. This contrasts with the best obtainable 2:1 forward to reverse heat transfer ratio at high cycle pressure ratio only in the prior art Stirling engines.

The ideal recommended Ericsson cycle efficiency, found by dividing $W_n$ by $Q_b$ as given above, reduces to $1-(T_a/T_b)$ It is equivalent to that of a Carnot cycle engine operating between the same two temperatures.

Heat exchanger hysteresis may be estimated by the same method used earlier. The adverse heat movements are presumed to occur at differing temperatures from the forward heat movements. In the example above, one may estimate that compression in $v_a$ will occur at 245° K. rather than 225° K., and thus require 245/225 or 1.09 times the ideal work. Similarly, the expansion in $v_b$ can be estimated to occur at 305° K. instead of 325° K., yielding only 94% the work of the ideal process. Because now only 10% of the gas charge in the machine is subject to the adverse conditions the cycle work requirement will be found to increase by just 5%. The coefficient of performance will be reduced only to 2.14 if the total heat absorption remains the same. Obviously, the recommended cycle can be much less susceptible to heat exchanger hysteresis loss than Stirling cycle machines of the prior art. Considerably greater efficiency remains after allowances for flow friction, heat leakage, mechanical friction and other losses.

Heat leakage across the regenerator is similarly reduced by operation in the recommended Ericsson cycle because gas motion between compartments is suppressed during the pressure changing operations, and cycle pressure ratio is low, holding the minimum quantity of gas in improved thermal equilibrium with the porous medium.

Clearly, all the conditions specified above will only be met at the absolute operating temperature ratio intended. At off-design conditions the machines will operate in a more or less Stirling cycle at more or less reduced efficiency.

The most straightforward machine meeting all the criteria is the cam actuated diaphragm sealed engine illustrated in FIG. 2. It is designed to operate as a refrigerator with a cold end gas temperature of 225° K. and a warm end gas temperature of 325° K.

With reference to FIG. 2, the engine comprises a heat rejecting section, 30, and a heat absorbing section, 10, joined in gas permeable communication through a regenerator, 50. The engine produces refrigeration within an insulated box 90.

The variable volume enclosed within the heat absorbing section, 10, is defined by a heat exchanger, 11, a thin walled tapered metal can, e.g. 1 mm aluminum. Within this can a piston, 13, made to fit closely within the inside surface of the heat exchanger 11, entirely fills the heat exchanger 11 can at top dead center. The piston, 13, is made of a lightweight insulating material such as rigid closed cell foam. The piston is supported on an endplate, 15, which is sealed into the heat exchanger by a roller diaphragm, 17. The endplate is connected to a cam follower, 19, via a reciprocating shaft 27*a*. A follower, 19, rides on a dive cam, 21, rotating with a main shaft, 71. Linear bearings 23*a* and 23*b* hold the endplate 15 centered and perpendicular within the heat exchanger 11 as the cam follower 19 driven by the cam 21 causes displacement of the piston up and down within the heat exchanger 11. The main shaft 71 is supported for free rotation in bearings 77 and 79.

The compartments 10 and 30 are precharged to an elevated gas pressure, e.g. 3 atmospheres, to maintain the cam followers in contact with the cams at the intended speed of operation, 10 cycles per second. The total volume of gas, i.e. helium, will obviously vary depending upon the engine capacity intended. However, for purposes of illustration, and consistent with the foregoing discussion, a suitable variable volume in compartment 10 would be 250 cc.

Gas communication with the regenerator 50 is made through a port 25. The regenerator is filled with metal fiber 51, bronze wool, oriented perpendicularly to the gas flow direction.

The heat rejecting section 30 communicates with the other end of the regenerator 50 through a port 45. Its construction is similar to that of the heat absorbing section. It too includes a heat exchanger can 31, a piston 33 which fills the can at top dead center, an endplate 35 with linear guides 47*a* and 47*b*, a cam follower 39, a diaphragm seal 37 and a drive cam 41 rotating with the main shaft 71.

The energy to drive the refrigeration cycle is provided by a motor 75 via a coupling 73 which turns the main shaft 71.

The principle difference between the two sections 10 and 30 arises from the need to scale the displacements by the absolute temperature ratio across which the device is intended to operate. Here, heat will be absorbed at 225° K. and rejected at 325° K. gas temperature. Thus the heat absorbing section 10 must have only 225/325 the displacement of the heat rejecting section 30. This displacement ratio will result in Ericsson cycle operation at the design temperature ratio when the pistons are properly actuated by the cams 21 and 41. Consistent with the present example, the variable volume of compartment b will be 325/225 the variable volume of compartment a, or 360 cc.

The displacement ratio may variously be obtained by giving one section a greater stroke than the other, enlarging the diameter of one section with respect to the other, or some combination of these two. The simplest cams result from making the ratio of piston diameters equal to the ratio of absolute temperatures.

Figure 3:
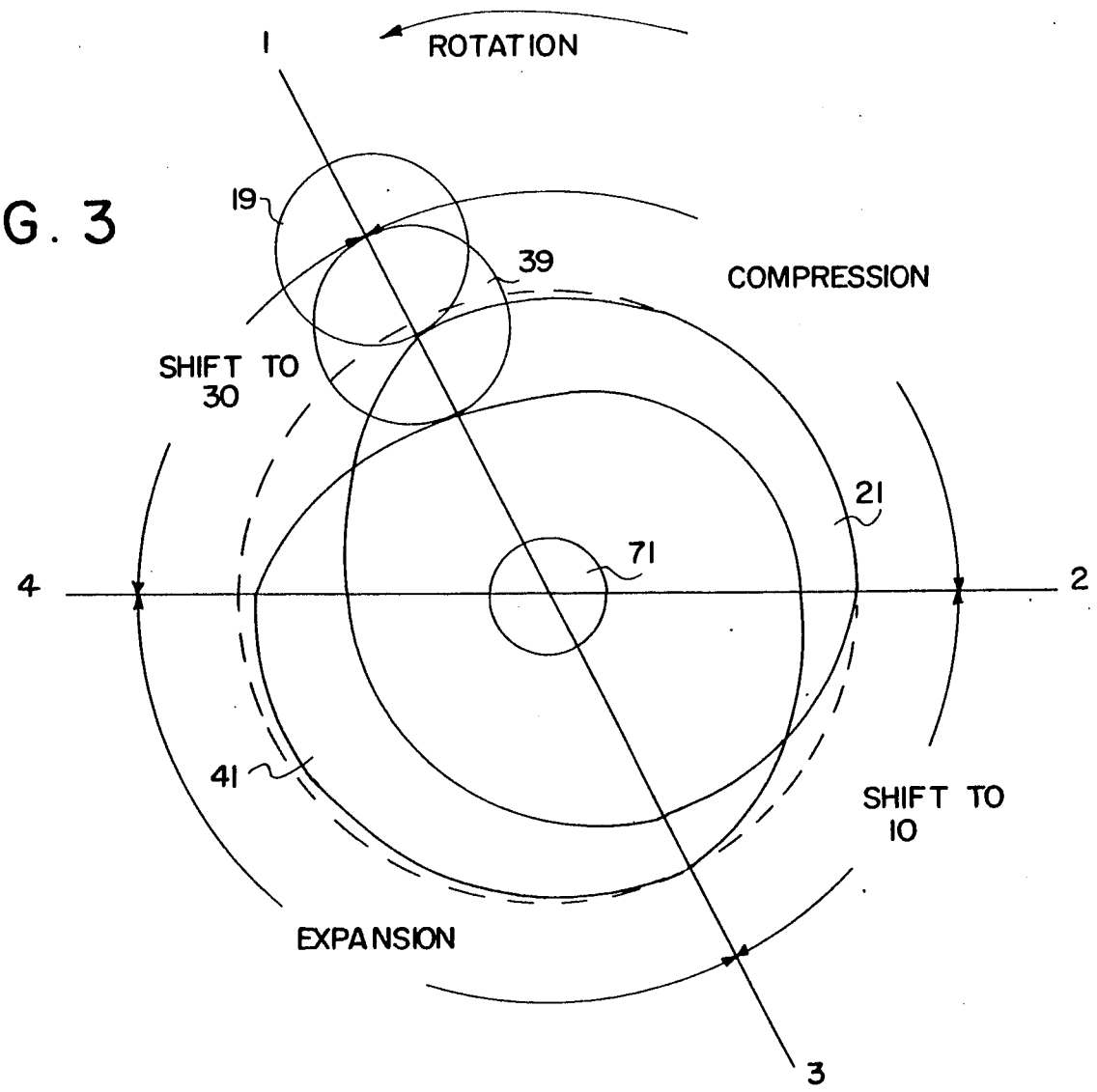
FIG. 3 is a timing diagram of cams which drive the variable volumes in the machine of FIG. 2.

Proper profiling and timing of the cams is important to efficiency. The cams for the engine of FIG. 2 are illustrated in FIG. 3. The two cam profiles are mirror images if the displacement ratio is obtained by making one piston a suitably larger diameter than the other, as has been done in the machine of FIG. 2.

The notable cam features and their relation to the successive stages of the Ericsson cycle are indicated in the FIG. 3. The Ericsson cycle requires a precise distinction between the compression, shift, expansion, and shift back stages. Both cams 21 and 41 include profile sections to provide for both compression and expansion. The two overlapping sections of the cam variations actuate the gas shifting stages of the cycle. The extent of these overlaps delimit the cycle pressure ratio of the device. Typically, only half of the cam variation is applied to compression or expansion, the other half of the cam variation being applied to shifting, limiting the pressure ratio to about 2:1. Use of cams to actuate the piston motion allows considerable freedom to allocate shaft rotation between the successive cycle stages. Generally it is best to profile such cams so that most of the rotational displacement is allocated to the compression and expansion stages to allow the greatest time for heat exchange. The lesser angular displacements are allocated to the shifts.

If the engine is operated slowly, e.g. 10 cycles per second (600 rpm), no balancing means need be provided. For higher speeds, e.g. 30 cycles per second (1800 rpm), balancing can be accomplished by driving reciprocating counterweights with suitable cams.

The cams described above to illustrate implementation of the invention are not the only means of approximating the recommended conditions. For instance, it is possible to add electromagnetic coils to existing free piston machines to skew the piston motions in the required manner. Alternatively, elaborate linkages can be devised to drive the pistons from cranks. The teachings of the present invention apply to all means of varying the volumes.

It should be noted that the recommended Ericsson cycle lends itself to the combination of an engine operating in conjunction with a refrigerator to create a thermally driven heat pump. Such machines may share a common heat rejection compartment sized large enough for both the engine and refrigeration displacements. The engine expansion compartment and the refrigeration expansion compartment operate in matched phase, and the displacement of each is proportional to its intended absolute operating temperature. Such machines are three compartment devices with two regenerators in which heat input directly drives a heat pumping process. This is an important field of application for the invention.

Obviously, it is possible to hold the volume of the reversed compartment at constant minimum during the adverse portion of the cycle, without performing the expansion and compression symmetrically in both compartments as recommended. This expedient slightly reduces the quantity of gas subject to adverse heat flow while preserving Carnot equivalency. Unfortunately, the adverse process will then drive the gas and the temperature difference front through the regenerator medium in the same direction in both the expansion and compression steps. The resulting increase of disequilibrium in the regenerator, and the explicit heat leak, both degrade the efficiency as compared to the recommended cycle and impedes efficient integration of engines with refrigerators.

Although described with reference to a specific system for refrigeration with a cam actuated diaphragm sealed refrigerator machine, the present invention is applicable to any positive displacement sealed gas variable volume heat engine, regardless of the geometry of heat exchangers, means of volume variation actuation, method of sealing, total number of compartments or other mechanical detail.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. An engine which comprises:

at least two variable volume compartments joined by a porous medium regenerator;

heat exchangers in heat exchange relationship with the variable volume compartments;

a fixed quantity of gas in said compartments;

a piston in each of the compartments;

means to control the pistons to vary the volumes of the gas transferring between the compartments in the form of overlapping quadrilateral waveforms to compress the gas in both compartments through the same cycle pressure ratio during a cycle compression step, to shift the gas between compartments and to expand the gas in both compartments through the same cycle pressure ratio during a cycle expansion step.

2. The engine of claim 1 wherein the means to control the pistons includes mechanical means.

3. The engine of claim 1 wherein the compartments are cylinders and the ratio of the cylinder diameters is the same as the ratio of the operating absolute temperatures.

4. The engine of claim 1 wherein the means to control the pistons includes cams.

5. The engine of claim 4 wherein the cams are configured to have overlapping sections to actuate the gas shifting stages of the cycle.

6. A method for exchanging heat which includes:

(a) compressing gas isothermally in first and second compartments through a predetermined cycle pressure ratio in a cycle compression step;

(b) shifting isobarically the gas from the first compartment to the second compartment through a regenerator;

(c) expanding the gas isothermally in both compartments in the same cycle pressure ratio during a cycle expansion step; and (d) shifting the gas isobarically from the second compartment to the first compartment through the regenerator; and (e) effecting steps (a) through (d) such that the volume variations of the gas are in the form of overlapping quadrilateral waveforms.

7. The method of claim 6 wherein prior to the compression step the heat rejecting volume in the first compartment is at its maximum capacity and the heat absorbing volume of the gas in the other compartment is at its minimum capacity.

* * * * *